US009700809B1

(12) United States Patent
Harris et al.

(10) Patent No.: US 9,700,809 B1
(45) Date of Patent: Jul. 11, 2017

(54) TOY VEHICLE HAULER TRUCK

(71) Applicants: Chet Harris, Milpitas, CA (US); Carol Harris, Milpitas, CA (US)

(72) Inventors: Chet Harris, Milpitas, CA (US); Carol Harris, Milpitas, CA (US)

( * ) Notice: Subject to any disclaimer, the term of this patent is extended or adjusted under 35 U.S.C. 154(b) by 105 days.

(21) Appl. No.: 14/685,692

(22) Filed: Apr. 14, 2015

(51) Int. Cl.
*A63H 17/05* (2006.01)

(52) U.S. Cl.
CPC ..... *A63H 17/05* (2013.01)

(58) Field of Classification Search
CPC ..... A63H 17/05
See application file for complete search history.

(56) References Cited

U.S. PATENT DOCUMENTS

| | | | | |
|---|---|---|---|---|
| D156,244 | S | 11/1949 | Josefsberg | |
| 3,039,229 | A | 6/1962 | Cleemput | |
| D193,150 | S | 7/1962 | Alvaney | |
| 3,675,366 | A | 7/1972 | Tomiyama | |
| 4,505,686 | A | 3/1985 | Mariol | |
| 4,708,683 | A | 11/1987 | Lehmann | |
| 6,520,829 | B1 | 2/2003 | Temple | |
| 2004/0009734 | A1 * | 1/2004 | Needham | A63H 17/002 446/94 |

FOREIGN PATENT DOCUMENTS

| | | | |
|---|---|---|---|
| CN | 201394356 | Y | 2/2010 |

OTHER PUBLICATIONS

Amazon.com: Customer Reviews: Freightliner Classic XL Car Hauler 1:32 Scale Diecast Truck Model, Dec. 10, 2010.*

* cited by examiner

*Primary Examiner* — Aarti B Berdichevsky
*Assistant Examiner* — Urszula M Cegielnik

(57) ABSTRACT

The toy vehicle truck hauler is a working model of a tractor trailer that is used for transporting vehicles. The toy vehicle truck hauler can be used to simulate loading and unloading model cars and for storing model cars. The toy vehicle truck hauler comprises a tractor and a trailer. The tractor further comprises a truck, a tractor hitch, a first frame, a first plurality of axles, a first plurality of wheels, a first plurality of chutes, a first plurality of lifts and a first plurality of extensions. The trailer further comprises a trailer hitch, a second frame, a second plurality of axles, a second plurality of wheels, a second plurality of chutes, a second plurality of lifts and a second plurality of extensions, and a plurality of shared lifts.

8 Claims, 6 Drawing Sheets

TOY VEHICLE HAULER TRUCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wheeled toys and toy models, more specifically, a model of a vehicle transport vehicle.

SUMMARY OF INVENTION

The toy vehicle truck hauler is a working model of a tractor trailer that is used for transporting vehicles. The toy vehicle truck hauler can be used to simulate loading and unloading model cars and for storing model cars. The toy vehicle truck hauler comprises a tractor and a trailer. The toy vehicle truck hauler is scaled down to be between $1/10^{th}$ and $1/50^{th}$ the actual size of a vehicle transport vehicle.

These together with additional objects, features and advantages of the toy vehicle truck hauler will be readily following detailed description of the presently preferred, but nonetheless illustrative, embodiments when taken in conjunction with the accompanying drawings.

In this respect, before explaining the current embodiments of the toy vehicle truck hauler in detail, it is to be understood that the toy vehicle truck hauler is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toy vehicle truck hauler.

It is therefore important that the claims be regarded as including such equivalent construction insofar as they do not depart from the spirit and scope of the toy vehicle truck hauler. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
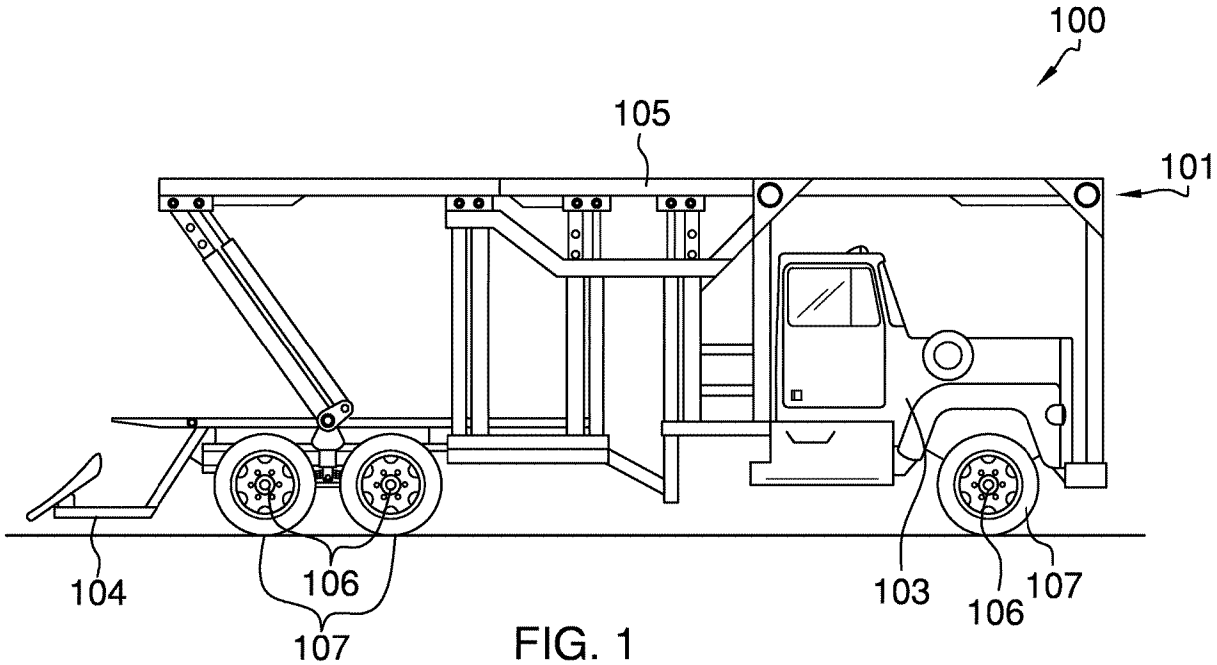
FIG. 1 is a detail view of an embodiment of the disclosure.
Figure 2:
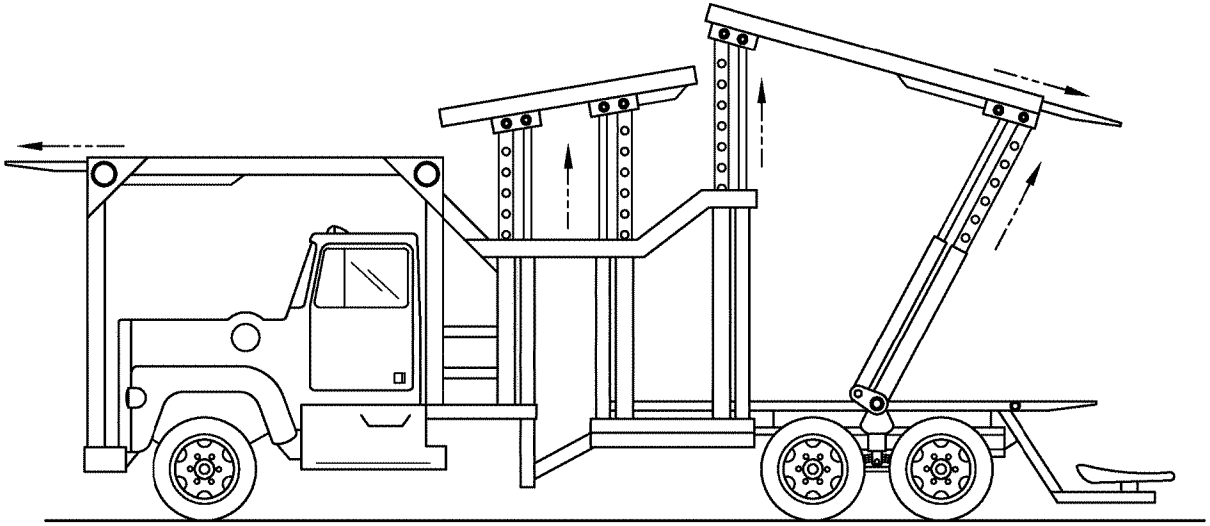
FIG. 2 is a detail view of an embodiment of the disclosure.
Figure 3:
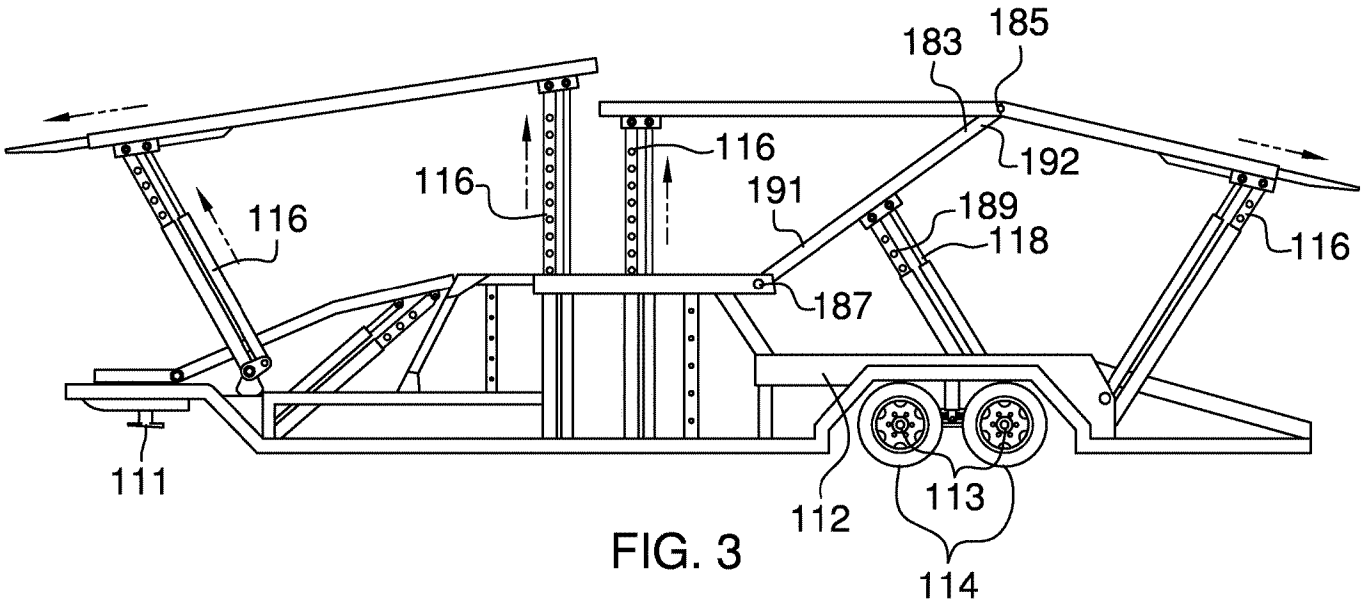
FIG. 3 is a detail view of an embodiment of the disclosure.
Figure 4:
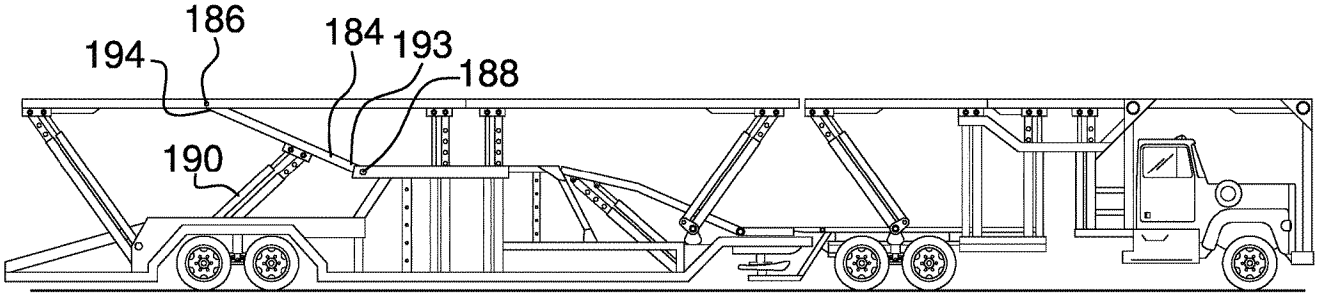
FIG. 4 is a side view of an embodiment of the disclosure.
Figure 5:
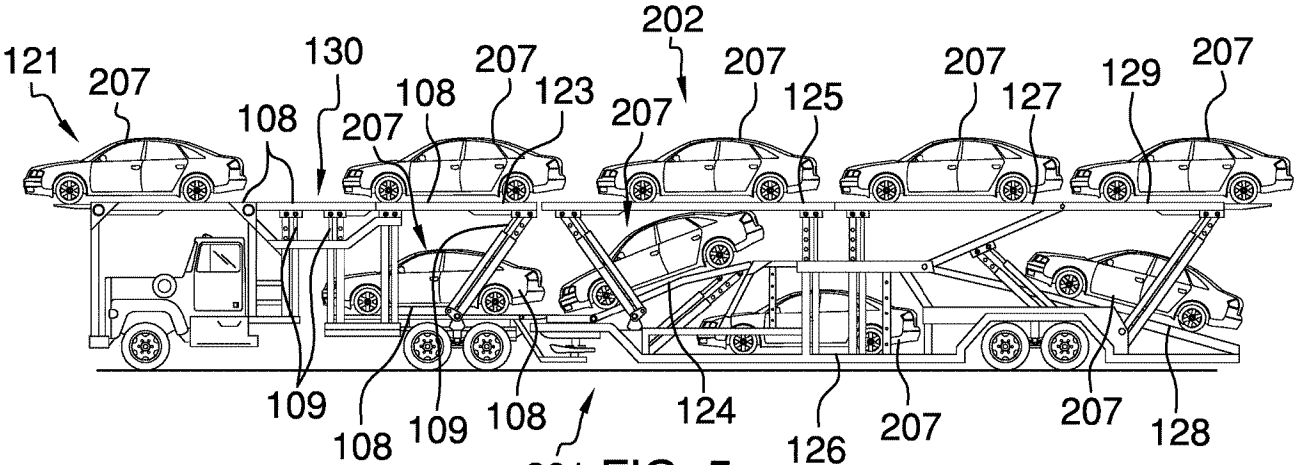
FIG. 5 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7. The toy vehicle truck hauler 100 (hereinafter invention) comprises a tractor 101 and a trailer 102.

The tractor 101 further comprises a truck 103, a tractor hitch 104, a first frame 105, a first plurality of axles 106, a first plurality of wheels 107, a first plurality of chutes 108, and a first plurality of lifts 109.

The truck 103 is a structure that is a structural representation of a motor vehicle that is attached to the front 203 side of the tractor 101.

The tractor hitch 104 is half of a coupling device that is mounted on the tractor 101. When attached to the matching half of the coupling device mounted on the trailer 102, the tractor 101 and the trailer 102 are joined and can be handled as a single unit.

The first frame 105 is a structure that is structural representation of the non-moving structural members of the tractor 101 portion of a vehicle transport vehicle. Each of the first plurality of axles 106, each of the first plurality of chutes 108, and each of the first plurality of lifts 109 are attached to the first frame 105.

Each of the first plurality of axles 106 is a central shaft to which two or more wheels selected from the first plurality of wheels 107 are affixed in such a way that they can rotate freely. Each of the first plurality of axles 106 is mounted on the bottom 201 of the first frame 105. Each of the first plurality of axles 106 is a scale representation of the axles used on a vehicle transport vehicle.

Each of the first plurality of wheels 107 is a circular component of the invention 100 that that rotates around the axis of the axle to facilitate movement of the invention 100. Each of the first plurality of wheels 107 is a scale representation of the wheels used on a vehicle transport vehicle.

Each of the first plurality of chutes 108 is a structure that is intended to provide a path over which the vehicle 207 being stored can be moved and to provide the final storage location. Generally, each of the first plurality of chutes 108 comprises a left ramp and a right ramp selected from the ramps is a structure that supports and guides the wheels of the vehicle 207. This is explained in significantly more detail elsewhere in this disclosure.

The first plurality of chutes 108 further comprises a first chute 121, a second chute 122, a third chute 123 and a tenth chute 130. The first chute further 121 comprises an eleventh ramp 131 and a twelfth ramp 132. The second chute 122 further comprises a thirteenth ramp 133 and a fourteenth ramp 134. The third chute 123 further comprises a fifteenth ramp 135 and a sixteenth ramp 136. The tenth chute 130 further comprises a twenty ninth ramp 149 and a thirtieth ramp 150. The purpose of the first chute 121 is to provide a location where a vehicle 207 can be stored. The purpose of the second chute 122 is to provide a location where a vehicle 207 can be stored. The purpose of the third chute 123 is to provide a location where a vehicle 207 can be stored and to provide a path over which a vehicle 207 can travel to reach the first chute 121. The purpose of the tenth chute 130 is to provide a path between the first chute 121 and the third chute 123 over which a vehicle 207 can travel.

Figure 6:
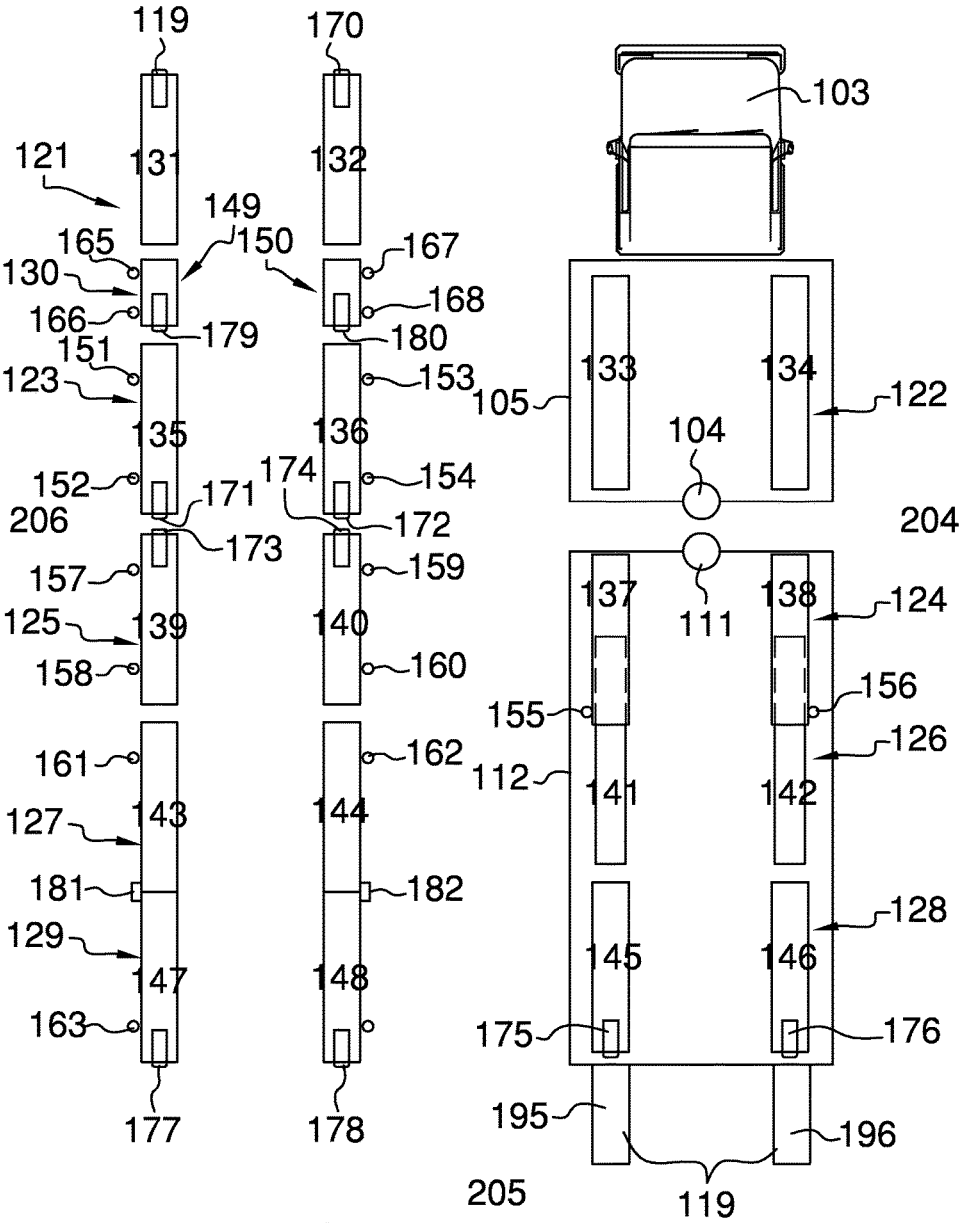
FIG. 6 is a schematic view of an embodiment of the disclosure.
Figure 7:
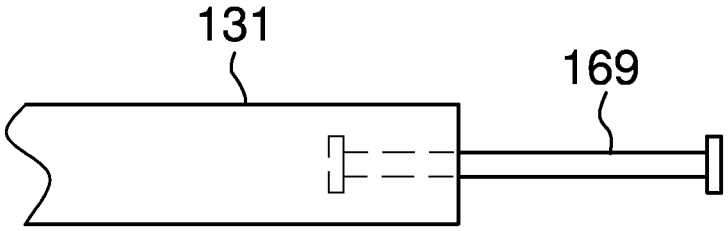
FIG. 7 is a detail view of an embodiment of the disclosure.

The eleventh ramp 131, the twelfth ramp 132, the fifteenth ramp 135, the sixteenth ramp 136, the twenty ninth ramp 149, and the thirtieth ramp 150 are fitted with a forty ninth extension fifty second extension 172, a fifty ninth extension 179 and a sixtieth extension 180 respectively. As shown in FIG. 7, each of the plurality of extensions is a panel that is mounted inside the corresponding ramp for the extension and that can be withdrawn, but not removed, from a corresponding ramp. The purpose of each of the plurality of extensions is to extend the span of the corresponding ramp of the individual extension. An extension can be used in this way to act as a bridge between two chutes. Alternatively, an extension can be used to extend the span of the corresponding ramp for vehicle 207 storage purposes. As shown in FIG. 6: the forty ninth extension 169 extends the eleventh ramp 131 towards the front 203 direction; the fiftieth extension 170 extends the twelfth ramp 132 towards the front 203 direction; the fifty first extension 171 extends the fifteenth ramp 135 towards the rear 205 direction; the fifty second extension 172 extends the sixteenth ramp 136 towards the rear 205 direction; the fifty ninth extension 179 extends the twenty ninth ramp 149 towards the rear 205 direction; and, the sixtieth extension 180 extends the thirtieth ramp 150 towards the rear 205 direction.

Each of the first plurality of lifts 109 is associated with a ramp selected from the plurality of ramps. Each of the first plurality of lifts 109 is an operable pneumatic cylinder purpose of each of the first plurality of lifts 109 is to raise or lower the associated ramp relative to the other ramps from the plurality of ramps to accommodate the transport or storage of a vehicle 207. By manipulating each of the first plurality of lifts 109 along with the second plurality of lifts 116 and the plurality of shared lifts 118 a series of travel paths can be created in order to transport a vehicle 207 to a storage location.

The first plurality of lifts 109 further comprises a thirty first lift 151, a thirty second lift 152, a thirty third lift 153, a thirty fourth lift 154, a forty fifth lift 165, a forty sixth lift 166, a forty seventh lift 167, and a forty eighth lift 168. The thirty first lift 151 is attached to the front 203 end of the fifteenth ramp 135. The thirty second lift 152 is attached to the rear 205 end of the fifteenth ramp 135. The thirty third lift 153 is attached to the front 203 end of the sixteenth ramp 136. The thirty fourth lift 154 is attached to the rear 205 end of the sixteenth ramp 136. The forty fifth lift 165 is attached to the front 203 end of the twenty ninth ramp 149. The forty sixth lift 166 is attached to the rear 205 end of the twenty ninth ramp 149. The forty seventh lift 167 is attached to the front 203 end of the thirtieth ramp 150. The forty eighth lift 168 is attached to the rear 205 end of the thirtieth ramp 150.

The trailer 102 further comprises a trailer hitch 111, a second frame 112, a second plurality of axles 113, a second plurality of wheels 114, a second plurality of chutes 115, a second plurality of lifts 116, a plurality of shared lifts 118, and an exit ramp 119.

The trailer hitch 111 is half of a coupling device that is mounted on the trailer 102. When attached to the matching half of the coupling device mounted on the tractor 101, the tractor 101 and the trailer 102 are joined and can be handled as a single unit.

The second frame 112 is a structure that is structural representation of the non-moving structural members of the trailer 102 portion of a vehicle transport vehicle. Each of the second plurality of axles 113, each of the second plurality of chutes 115, each of the second plurality of lifts 116, and the plurality of shared lifts 118 are attached to the second frame 112.

Each of the second plurality of axles 113 is a central shaft to which two or more wheels selected from the second plurality of wheels 114 are affixed in such a way that they can rotate freely. Each of the second plurality of axles 113 is mounted on the bottom 201 of the second frame 112. Each of the second plurality of axles 113 is a scale representation of the axels used on a vehicle transport vehicle.

Each of the second plurality of wheels 114 is a circular component of the invention 100 that that rotates around the axis of the axle to facilitate movement of the invention 100. Each of the second plurality of wheels 114 is a scale representation of the wheels used on a vehicle transport vehicle.

Each of the second plurality of chutes 115 is a structure that is intended to provide a path over which the vehicle 207 being stored can be moved and to the final storage location. Generally, each of the second plurality of chutes 115 comprises a left ramp and a right ramp selected from the plurality of ramps where each ramp provides a track over which the wheels of the vehicle 207 being stored can be transported. Each ramp selected from the plurality of ramps is a structure that supports and guides the wheels of the vehicle 207. This is explained in significantly more detail elsewhere in this disclosure.

The second plurality of chutes 115 further comprises a fourth chute 124, a fifth chute 125, a sixth chute 126, a seventh chute 127, an eighth chute 128, and a ninth chute 129. The fourth chute 124 further comprises a seventeenth ramp 137 and an eighteenth ramp 138. The fifth chute 125 further comprises a nineteenth ramp 139 and a twentieth ramp 140. The sixth chute 126 further comprises a twenty first ramp 141 and a twenty second ramp 142. The seventh chute 127 further comprises a twenty third ramp 143 and a twenty fourth ramp 144. The eighth chute 128 further comprises a twenty fifth ramp 145 and a twenty sixth ramp 146. The ninth chute 129 further comprises a twenty seventh ramp 147 and a twenty eighth ramp 148. The purpose of the fourth chute 124 is to provide a location where a vehicle 207 can be stored and to provide a path over which a vehicle 207 can travel. The purpose of the fifth chute 125 is to provide a location where a vehicle 207 can be stored and to provide a path over which a vehicle 207 can travel. The purpose of the sixth chute 126 is to provide a location where a vehicle 207 can be stored and to provide a path over which a vehicle 207 can travel. Through the use of the thirty fifth lift 155 and thirty sixth lift 156, discussed elsewhere in this application, the sixth chute 126 stores a vehicle 207 partially underneath the fourth chute 124. The purpose of the seventh chute 127 is to provide a location where a vehicle 207 can be stored and to provide a path over which a vehicle 207 can travel.

The purpose of the eighth chute 128 is to provide a location where a vehicle 207 can be stored and to provide a path over which a vehicle 207 can travel. The purpose of the ninth chute 129 further is to provide a location where a vehicle 207 can be stored and to provide a path over which a vehicle 207 can travel.

The nineteenth ramp 139, the twentieth ramp 140, the twenty fifth ramp 145, the twenty sixth ramp 146, the twenty seventh ramp 147, and the twenty eighth ramp 148 are fitted with a fifty third extension 173, a fifty fourth extension 174, a fifty fifth extension 175, a fifty sixth extension 176, a fifty seventh extension 177 and a fifty eighth extension 178 respectively. As shown in FIG. 7, each of the plurality of extensions is a panel that is mounted inside the corresponding ramp for the extension and that can be withdrawn, but not removed, from a corresponding ramp. The purpose of each of the plurality of extensions is to extend the span of the corresponding ramp of the individual extension. An extension can be used in this way to act as a bridge between two chutes. Alternatively, an extension can be used to extend the span of the corresponding ramp for vehicle 207 storage purposes. As shown in FIG. 6: the fifty third extension 173 extends the nineteenth ramp 139 towards the front 203 direction; the fifty fourth extension 174 extends the twentieth ramp 140 towards the front 203 direction; the fifty fifth extension 175 extends the twenty fifth ramp 145 towards the rear 205 direction; the fifty sixth extension 176 extends the twenty sixth ramp 146 towards the rear 205 direction; the fifty seventh extension 177 extends the twenty seventh ramp 147 towards the rear 205 direction; and, the fifty eighth extension 178 extends the twenty eighth ramp 148 towards the rear 205 direction.

Each of the second plurality of lifts 116 is associated with a ramp selected from the plurality of ramps. Each of the second plurality of lifts 116 is an operable pneumatic cylinder selected and modified to look like a hydraulic lift. The purpose of each of the second plurality of lifts 116 is to raise or lower the associated ramps to accommodate the transport or storage of a vehicle 207. By manipulating each of the first plurality of lifts 109 along with the second plurality of lifts 116 and the plurality of shared lifts 118 a series of travel paths can be created in order to transport a vehicle 207 to a storage location.

The second plurality of lifts 116 further comprises a thirty fifth lift 155, a thirty sixth lift 156, a thirty seventh lift 157, a thirty eighth lift 158, a thirty ninth lift 159, a fortieth lift 160, a forty first lift 161, a forty second lift 162, a forty third lift 163, and forty fourth lift 164. The thirty fifth lift 155 is attached to the rear 205 end of the seventeenth ramp 137. The thirty sixth lift 156 is attached to the rear 205 end of the eighteenth ramp 138. The thirty seventh lift 157 is attached to the front 203 end of the nineteenth ramp 139. The thirty eighth lift 158 is attached to the rear 205 end of the nineteenth ramp 139. The thirty ninth lift 159 is attached to the front 203 end of the twentieth ramp 140. The fortieth lift 160 is attached to the rear 205 end of the twentieth ramp 140. The forty first lift 161 is attached to the front 203 end of the twenty third ramp 143. The forty second lift 162 is attached to the front 203 end of the twenty fourth ramp 144. The forty third lift 163 is attached to the rear 205 end of the twenty seventh ramp 147. The forty fourth lift 164 is attached to the rear 205 end of the twenty eighth ramp 148.

Each of the plurality of shared lifts 118 is associated with two ramps selected from the plurality of ramps that are joined together by a pivoting joint that allows the two ramps to rotate relative to each other. In general, each of the plurality of shared lifts 118 comprises an operable pneumatic cylinder selected and modified to look like a hydraulic lift and a lift beam. The purpose of each of the plurality of shared lifts 118 is to raise or lower the associated pivot joint to accommodate the transport or storage of a vehicle 207. By manipulating each of the first plurality of lifts 109 along with the second plurality of lifts 116 and the plurality of shared lifts 118 a series of travel paths can be created in order to transport a vehicle 207 to a storage location. Each of the plurality of shared lifts 118 moves a lift beam connected to a beam pivot point and to the pivot point connecting the two ramps selected from the plurality of ramps that are joined together by a pivoting joint. The operable pneumatic cylinder pushes against the lift beam which rotates around the beam pivot joint. This rotation moves the pivot joint adjusts the relative position of the two ramps selected from the plurality of ramps. This is explained in significantly more detail elsewhere in this disclosure.

The plurality of shared lifts 118 comprises a sixty first shared lift 181 and a sixty second shared lift 182.

The sixty first shared lift 181 further comprises a sixty ninth pneumatic cylinder 189, a sixty third shared lift beam 183, a sixty fifth pivot joint 185, and a sixty seventh beam pivot joint 187. The sixty fifth pivot joint 185 is used to attach the rear 205 end of the twenty third ramp 143 and the front 203 end of the twenty seventh ramp 147. The sixty third shared lift beam 183 is further defined with a seventy first end 191 and a seventy second end 192. The seventy first end 191 of the sixty third shared lift beam 183 is attached to the sixty fifth pivot joint 185. The seventy second end 192 of the sixty third shared lift beam 183 is attached to the second frame 112. The sixty ninth pneumatic cylinder 189 is an operable pneumatic cylinder selected and modified to look like a hydraulic lift. The sixty ninth pneumatic cylinder 189 is mounted on the second frame 112. The head (working end) of the sixty ninth pneumatic cylinder 189 is attached to the body of the sixty third shared lift beam 183. When the sixty ninth pneumatic cylinder 189 extends or retracts, the sixty third shared lift beam 183 rotates around the sixty seventh beam pivot joint 187. This motion raises or lowers the sixty fifth pivot joint 185 which changes the relative positions of the twenty third ramp 143 and the twenty seventh ramp 147.

The sixty second shared lift 182 further comprises a seventieth pneumatic cylinder 190, a sixty fourth shared lift beam 184, a sixty sixth pivot joint 186, and a sixty eighth beam pivot joint 188. The sixty sixth pivot joint 186 is used to attach the rear 205 end of the twenty fourth ramp 144 and the front 203 end of the twenty eighth ramp 148. The sixty fourth shared lift beam 184 is further defined with a seventy third end 193 and a seventy fourth end 194. The seventy third end 193 of the sixty fourth shared lift beam 184 is attached to the sixty sixth pivot joint 186. The seventy fourth end 194 of the sixty fourth shared lift beam 184 is attached to the second frame 112. The seventieth pneumatic cylinder 190 is an operable pneumatic cylinder selected and modified to look like a hydraulic lift. The seventieth pneumatic cylinder 190 is mounted on the second frame 112. The head (working end) of the seventieth pneumatic cylinder 190 is attached to the body of the sixty fourth shared lift beam 184. When the seventieth pneumatic cylinder 190 extends or retracts the sixty fourth shared lift beam 184 rotates around the sixty eighth beam pivot joint 188. This motion raises or lowers the sixty sixth pivot joint 186 which changes the relative positions of the twenty fourth ramp 144 and the twenty eighth ramp 148.

The exit ramp 119 further comprises a seventy fifth extension 195 and a seventy sixth extension 196. The seventy fifth extension 195 and the seventy sixth extension 196 are identical in construction to other extensions in the plurality of extensions. The seventy fifth extension 195 and the seventy sixth extension 196 are mounted in the rear 205 of the second frame 112 in a manner similar to that shown in FIG. 7. The purpose of the exit ramp 119 is to provide a path to bring the vehicles 207 into the invention 100.

The following definitions and directional references were used in this disclosure.

Plurality of Ramps: As used in this disclosure, the plurality of ramps is a descriptive term that generally refers to all the ramps that are associated with the plurality of chutes 115.

Plurality of Extensions: As used in this disclosure, the plurality of extensions is a descriptive term that generally refers to all the extensions that are associated with the plurality of ramps.

Vehicle: As used in this disclosure, a vehicle is a model of an automobile, motorcycle, pickup truck, or van.

Directional References: The directional references used in this disclosure are as follows. The wheels are mounted on the bottom 201, of the invention 100. The side distal from the bottom 201 side, is called the top 202 side. The truck 103 is placed at the front 203 side of the invention 100. When viewed from the top 202 side, as in FIG. 6, the remaining sides, in clockwise order, are called the right 204 side, rear 205 side and left 206 side. In this disclosure, when the location of a first object and a second object are compared: 1) if the first object is closer to the top 202 side than the second object, the first object is said to be above the second object and the second object is said to be below the first object; 2) if the first object is closer to the front 203 side than the second object, the first object is said to be in front 203 of the second object and the second object is said to be behind the first object; 3) if the first object is closer to the left 206 side than the second object, the first object is said to be to the left 206 of the second object and the second object is said to be to the right 204 of the first object.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A vehicle transport vehicle comprising:

a tractor and a trailer;

wherein the vehicle transport vehicle is a model;

wherein the vehicle transport vehicle is scaled to be less than 10.1% of the size of an actual vehicle transport vehicle;

wherein the vehicle transport vehicle simulates the loading and unloading of vehicles onto the vehicle transport vehicle;

wherein the vehicle transport vehicle can be used to store vehicles;

wherein the tractor further comprises a truck, a tractor hitch, a first frame, a first plurality of axles, a first plurality of wheels, a first plurality of chutes, and a first plurality of lifts;

wherein the trailer further comprises a trailer hitch, a second frame, a second plurality of axles, a second plurality of wheels, a second plurality of chutes, a second plurality of lifts, a plurality of shared lifts, and an exit ramp;

wherein the tractor hitch is mounted on the tractor;

wherein the trailer hitch is mounted on the trailer;

wherein the tractor hitch is can be attached to the trailer hitch;

wherein each of the first plurality of chutes provides a path over which the vehicle is moved;

wherein each of the first plurality of chutes comprises a left ramp selected from a plurality of ramps and a right ramp selected from the plurality of ramps;

wherein each of the second plurality of chutes provides a path over which the vehicle is moved;

wherein each of the second plurality of chutes comprises a left ramp selected from a plurality of ramps and a right ramp selected from the plurality of ramps;

wherein the first plurality of chutes is further defined with a first chute, a second chute, a third chute and a tenth chute;

wherein the second plurality of chutes is further defined with a fourth chute, a fifth chute, a sixth chute, a seventh chute, an eighth chute, and a ninth chute;

wherein the first chute further comprises an eleventh ramp and a twelfth ramp;

wherein the second chute further comprises a thirteenth ramp and a fourteenth ramp;

wherein the third chute further comprises a fifteenth ramp and a sixteenth ramp;

wherein the tenth chute further comprises a twenty ninth ramp and a thirtieth ramp;

wherein the fourth chute further comprises a seventeenth ramp and an eighteenth ramp;

wherein the fifth chute further comprises a nineteenth ramp and a twentieth ramp;

wherein the sixth chute further comprises a twenty first ramp and a twenty second ramp;

wherein the seventh chute further comprises a twenty third ramp and a twenty fourth ramp;

wherein the eighth chute further comprises a twenty fifth ramp and a twenty sixth ramp;

wherein the ninth chute further comprises a twenty seventh ramp and a twenty eighth ramp;

wherein the sixth chute extends underneath the fourth chute.

2. The vehicle transport vehicle according to claim 1 wherein the eleventh ramp, the twelfth ramp, the fifteenth ramp, the sixteenth ramp, the twenty ninth ramp, and the thirtieth ramp are fitted with a forty ninth extension, a fiftieth extension, a fifty first extension, a fifty second extension, a fifty ninth extension and a sixtieth extension, respectively;

wherein the nineteenth ramp, the twentieth ramp, the twenty fifth ramp, the twenty sixth ramp, the twenty seventh ramp, and the twenty eighth ramp are fitted with a fifty third extension, a fifty fourth extension, a fifty fifth extension, a fifty sixth extension, a fifty seventh extension and a fifty eighth extension, respectively.

3. The vehicle transport vehicle according to claim 2 wherein each of the first plurality of lifts is a pneumatic cylinder;

wherein each of the second plurality of lifts is a pneumatic cylinder.

4. The vehicle transport vehicle according to claim 3 wherein the first plurality of lifts further comprises a thirty first lift, a thirty second lift, a thirty third lift, a thirty fourth lift, a forty fifth lift, a forty sixth lift, a forty seventh lift, and a forty eighth lift;

wherein the second plurality of lifts further comprises a thirty fifth lift, a thirty sixth lift, a thirty seventh lift, a thirty eighth lift, a thirty ninth lift, a fortieth lift, a forty first lift, a forty second lift, a forty third lift, and forty fourth lift.

5. The vehicle transport vehicle according to claim 4 wherein the thirty first lift is attached to the front end of the fifteenth ramp;

wherein the thirty second lift is attached to the rear end of the fifteenth ramp;

wherein the thirty third lift is attached to the front end of the sixteenth ramp;

wherein the thirty fourth lift is attached to the rear end of the sixteenth ramp;

wherein the forty fifth lift is attached to the front end of the twenty ninth ramp;

wherein the forty sixth lift is attached to the rear end of the twenty ninth ramp wherein the forty seventh lift is attached to the front end of the thirtieth ramp;

wherein the forty eighth lift is attached to the rear end of the thirtieth ramp;

wherein the thirty fifth lift is attached to the rear end of the seventeenth ramp;

wherein the thirty sixth lift is attached to the rear end of the eighteenth ramp;

wherein the thirty seventh lift is attached to the front end of the nineteenth ramp;

wherein the thirty eighth lift is attached to the rear end of the nineteenth ramp;

wherein the thirty ninth lift is attached to the front end of the twentieth ramp;

wherein the fortieth lift is attached to the rear end of the twentieth ramp;

wherein the forty first lift is attached to the front end of the twenty third ramp;

wherein the forty second lift is attached to the front end of the twenty fourth ramp;

wherein the forty third lift is attached to the rear end of the twenty seventh ramp;

wherein the forty fourth lift is attached to the rear end of the twenty eighth ramp;

wherein the plurality of shared lifts further comprises a sixty first shared lift and a sixty second shared lift.

6. The vehicle transport vehicle according to claim 5 wherein the sixty first shared lift further comprises a sixty ninth pneumatic cylinder, a sixty third shared lift beam, a sixty fifth pivot joint, and a sixty seventh beam pivot joint;

wherein the sixty second shared lift further comprises a seventieth pneumatic cylinder, a sixty fourth shared lift beam, a sixty sixth pivot joint, and a sixty eighth beam pivot joint.

7. The vehicle transport vehicle according to claim 6 wherein the sixty fifth pivot joint is used to attach the rear end of the twenty third ramp and the front end of the twenty seventh ramp;

wherein the sixty third shared lift beam is further defined with a seventy first end and a seventy second end;

wherein the seventy first end of the sixty third shared lift beam is attached to the sixty fifth pivot joint;

wherein the seventy second end of the sixty third shared lift beam is attached to the second frame;

wherein the sixty ninth pneumatic cylinder is attached to the sixty third shared lift beam;

wherein the sixty sixth pivot joint is used to attach the rear end of the twenty fourth ramp and the front end of the twenty eighth ramp;

wherein the sixty fourth shared lift beam is further defined with a seventy third end and a seventy fourth end;

wherein the seventy third end of the sixty fourth shared lift beam is attached to the sixty sixth pivot joint;

wherein the seventy fourth end of the sixty fourth shared lift beam is attached to the second frame;

wherein the seventieth pneumatic cylinder is an operable pneumatic cylinder is attached to the sixty fourth shared lift beam.

8. The vehicle transport vehicle according to claim 7 wherein the exit ramp further comprises a seventy fifth extension and a seventy sixth extension.

* * * * *